US007445285B2

(12) United States Patent
Cohen

(10) Patent No.: US 7,445,285 B2
(45) Date of Patent: Nov. 4, 2008

(54) MODULAR CHILDREN'S FURNITURE

(75) Inventor: Jessica Beth Cohen, Tel Aviv (IL)

(73) Assignee: Jessica Cohen, Tel Aviv (IL)

( * ) Notice: Subject to any disclaimer, the term of this patent is extended or adjusted under 35 U.S.C. 154(b) by 0 days.

(21) Appl. No.: 11/500,327

(22) Filed: Aug. 8, 2006

(65) Prior Publication Data

US 2007/0040427 A1 Feb. 22, 2007

Related U.S. Application Data

(60) Provisional application No. 60/709,006, filed on Aug. 18, 2005.

(51) Int. Cl.
*A47C 15/00* (2006.01)

(52) U.S. Cl. ..... 297/219.1; 297/233; 297/181; 297/452.16

(58) Field of Classification Search ..... 297/233, 297/181, 219.1, 452.26, 452.48
See application file for complete search history.

(56) References Cited

U.S. PATENT DOCUMENTS 3,469,882 A * 9/1969 Larsen ..... 297/118
3,964,790 A * 6/1976 Bergeron ..... 297/451.5
4,679,262 A * 7/1987 Davis et al. ..... 5/644
D296,853 S * 7/1988 Slater ..... D6/434
D376,367 S * 12/1996 Mailandt ..... D14/230
6,116,682 A * 9/2000 Baur ..... 297/181
6,578,218 B2 * 6/2003 Wassilefsky ..... 5/648
6,823,545 B1 * 11/2004 Davis ..... 5/630
7,089,615 B1 * 8/2006 Parimuha ..... 5/636

* cited by examiner

*Primary Examiner*—Joe Edell

(57) ABSTRACT

Presented herein is an article of furniture for play and education, comprising a set of attachable cushions, each of which has at least one concave surface. When the set of cushions is arranged with the concave surfaces creating a substantially concentric interior surface, the article of furniture forms a substantially spherical shape with the substantially concentric interior surface forming a hollow core in the middle of the article of furniture. This hollow core provides an area in which a child may stand, hide, sit, or roll and the like. The cushions may also be configured into a variety of other shapes, such as a rocking chair, a crib, a ball with a large inner cavity for rolling or hiding, a down-turned hemisphere on which a child may sit, and so forth.

15 Claims, 10 Drawing Sheets

MODULAR CHILDREN'S FURNITURE

This application is a continuation-in-part of U.S. provisional patent application No. 60/709006, filed Aug. 18, 2005, the entire contents of which is herein incorporated by reference.

FIELD OF THE INVENTION

The invention relates to the fields of children's furniture and children's toys, particularly educational toys.

BACKGROUND OF THE INVENTION

Many commercial playground toys exist that provide educational and recreational activities for groups of children. However, after reviewing the prior art, none can be re-assembled from a ball with an inner cavity for hiding or rolling, to a rocking-chaise, to a floor cushion for leaning, while leaving open the possibilities for other assemblies, thus asking the child to think creatively about his/her environment. The prior art prescribes defined uses among a defined number of children. What is needed is a toy that can be reconfigured into different forms of furniture that may be used by one or two children, or a group of children, while encouraging children to think creatively and to cooperate together in constructing them.

Much of the prior art discloses wedge-shaped cushions with fasteners designed for uses such as safety, physiotherapy, or plumbing. None of these cushions features a trapezoidal-like section. Furthermore, a child may enjoy using the present invention while using only one or a portion of the full assembly of cushions for a plurality of creative uses, while the prior art require using all elements of the assembly for one prescribed use. Furthermore, the disclosed wedge-shaped cushions contain only flat faces, while the present invention contains flat faces and curved surfaces, whereby providing more organic and ergonomic forms.

The invention is an improvement over the prior art because it is a toy that provides added educational value. It encourages children to consider different types of play activities, and explore different types of ergonomic interactions between their bodies and the furniture.

LIST OF DRAWINGS

LIST OF REFERENCES IN THE DRAWINGS

Figure 1:
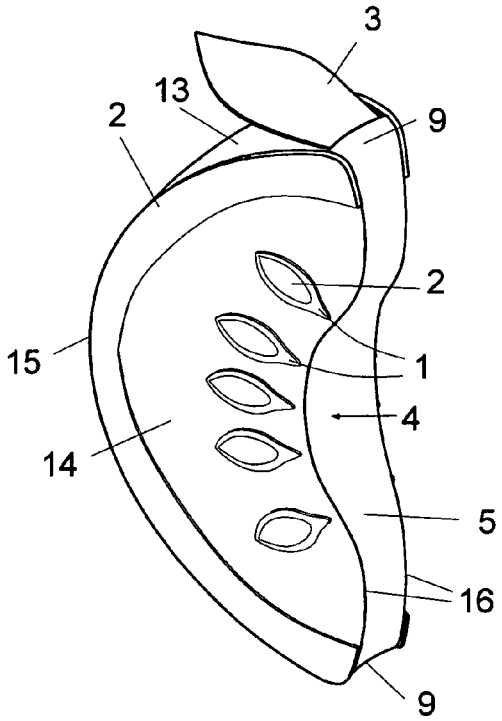
FIG. 1 is a perspective view of a cushion.

1 decorative, semi-fastening material, such as polypropylene felt
2 hook and loop fasteners (such as Velcro)
3 decorative elements that guide assembly
4 recess created by inner profile of said cushion's flat slanted faces
5 said cushion's inner concave surface
6 a re-sealable opening along said cushion's exterior cover
7 said cushion's inner base
8 the two slanted lines of said cushion's trapezoidal section
9 two graduated tips at opposite ends of said cushion
10 imaginary central axis of the spherical assembly
11 a hollow, open space through the center of said cushions' spherical assembly
12 the two concentric rings of said cushion's trapezoidal section
13 said cushion's outer convex surface
14 said cushion's flat slanted faces
15 generally round contour created by interface between the convex outer surface 13 and flat slanted face 14
16 recessed contour created by interface between the concave inner surface and flat slanted face 14
17 said cushion's exterior cover

DESCRIPTION OF DRAWINGS WITH PREFERRED EMBODIMENT

Figure 16:
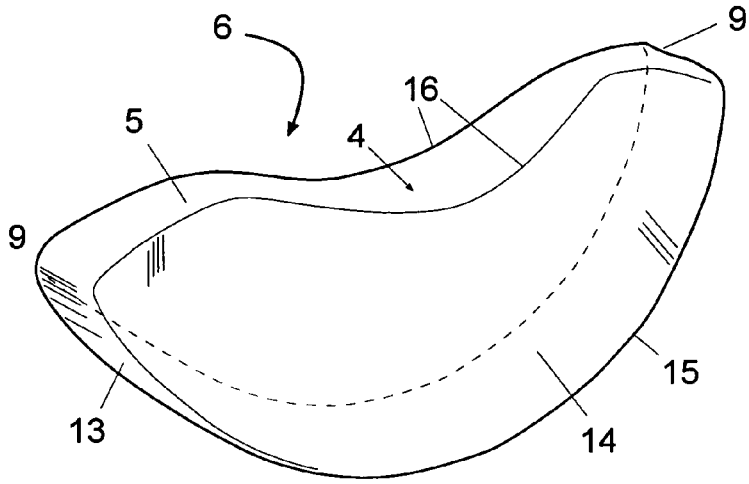
FIGS. 16 and 17 are perspective views of a cushion disassembled into the inner and outer components, respectively.

FIGS. 1 3 4 and 5 show the preferred embodiment of a wedge-like cushion. The cushion's form is composed of 4 surfaces, an outer convex surface 13, and inner concave surface 5, and two substantially similar flat, slanted faces 14. Said surfaces 13 and 14 create a generally round contour 15. Said surfaces 5 and 14 create a generally convex, recessed contour 16. Patches of hook and loop fasteners (such as Velcro) 2 are strategically arrayed on said cushion's flat faces 14, close to the edges 15 16, in order to provide the strongest tactical bond among cushions with the minimum amount of fastener. It is assumed that one slanted face 14 contains hook fasteners and the opposite slanted face 14 contains loop fasteners, and that such pattern is repeated among the assembly of cushions. Affixed to 14 may also be areas of polypropylene felt 1. Polypropylene felt is softer to the touch than Velcro's loop side, and the inventor found that it creates a weaker but satisfactory bond when in contact with Velcro. The felt is also advantageous for the design because it is commercially available in a variety of lively colors. Color-coding communicates to users where to connect the parts together. Said cushion comprises two graduated tips 9 at either end. Affixed to one or both graduated tips is a decorative element 3 that may be used to visually direct the user to align the cushions in the correct, alternating hook-and-loop series. Said decorative element 3 helps the user understand which side is "up". Decorative elements 3 may appear at both graduated tips 9 provided that they appear substantially different, in shape, size, color and so forth 6 shows a mechanism for closing a removable cover (FIG. 17) over an inner base (FIG. 16).

Figure 2:
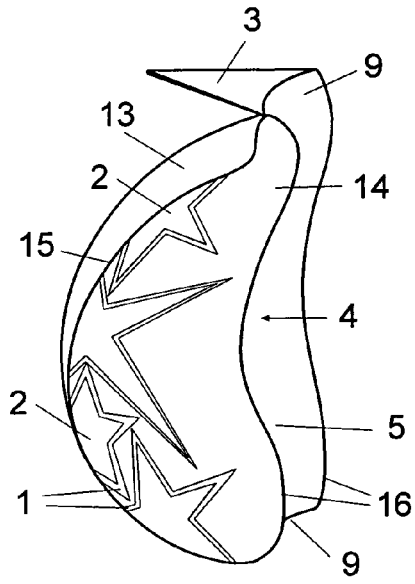
FIG. 2 is a perspective view of an alternate embodiment of said cushion.
Figure 3:
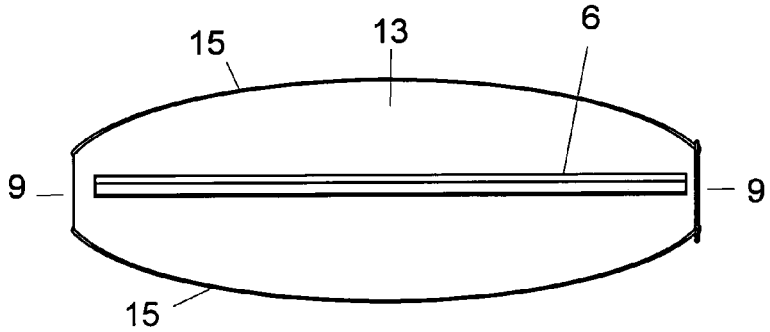
FIG. 3 is a view of the outer surface of said cushion.
Figure 4:
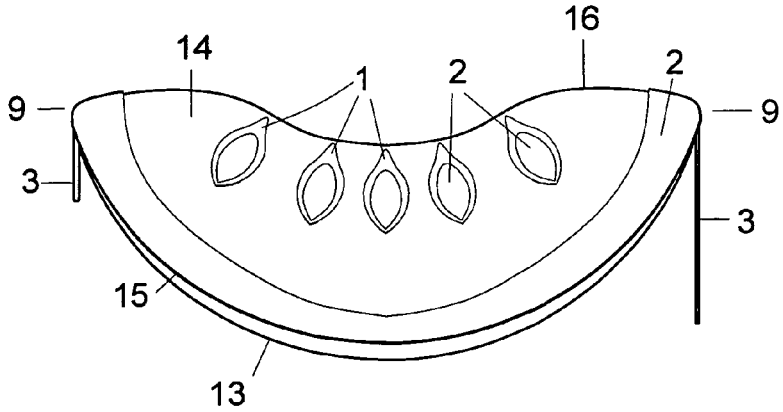
FIG. 4 is a view of the inner faces of said cushion.
Figure 5:
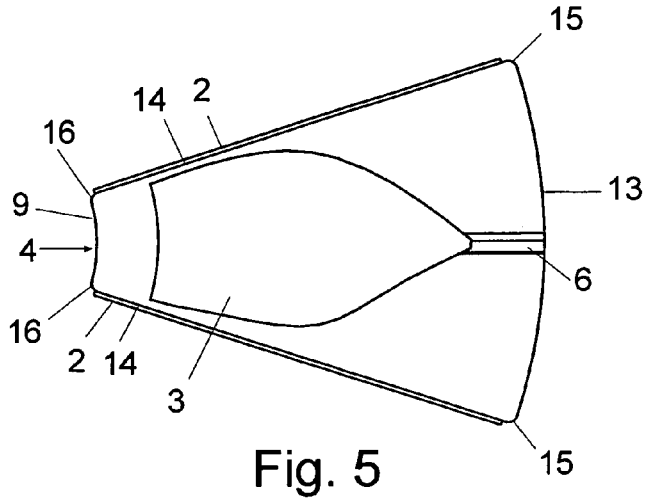
FIG. 5 is a top view of said cushion.

FIG. 2 shows an alternate embodiment of said cushion. Said alternate embodiment retains all advantages and features disclosed but contains some design differences.

Figure 6:
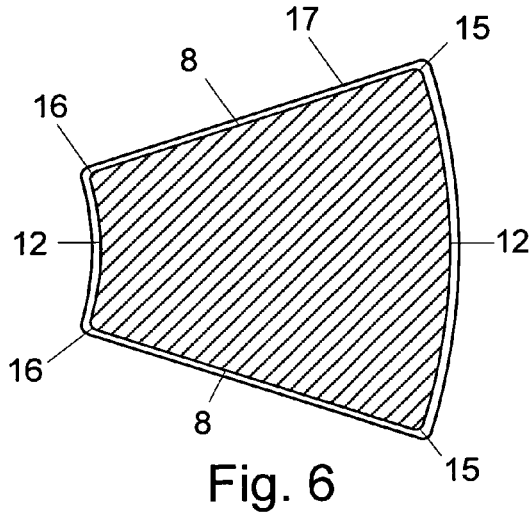
FIG. 6 is a cross-section view of said cushion.
Figure 7:
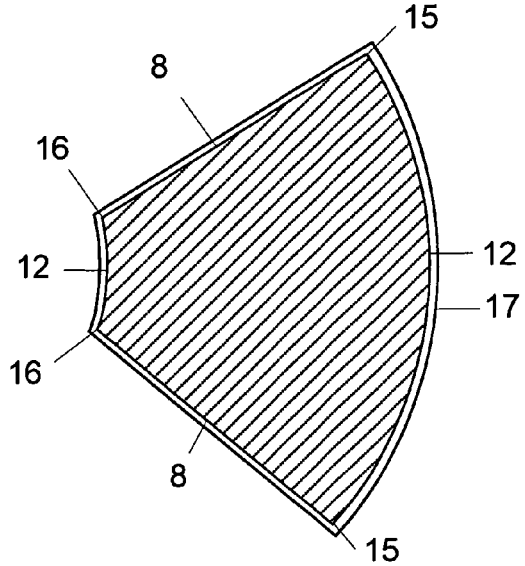
FIG. 7 is a cross-section view of an alternate embodiment of said cushion.

FIG. 6 shows the trapezoidal-like section of a cushion, and FIG. 7. shows said section of an alternate embodiment of said cushion. The section is comprised of two slanted lines 8 and two concentric rings 12. Said slanted lines 8 correspond to the cushion's flat surfaces 14. Said concentric rings 12 correspond to the cushion's concave 9 and convex 13 surfaces. Vertices 15 and 16 are created at the points where 8 and 12 meet. Aligning ten sections of (FIG. 6), by placing said concentric rings 12 in a concentric configuration, and said slanted lines adjacent to each other, creates a ring-like section. This assembly corresponds to the three-dimensional spherical assembly of cushions shown in FIGS. 11 12 and 13. Aligning six sections shown in (FIG. 7) also creates a similar ring-like section, corresponding to an alternate embodiment shown in FIG. 19.

Figure 8:
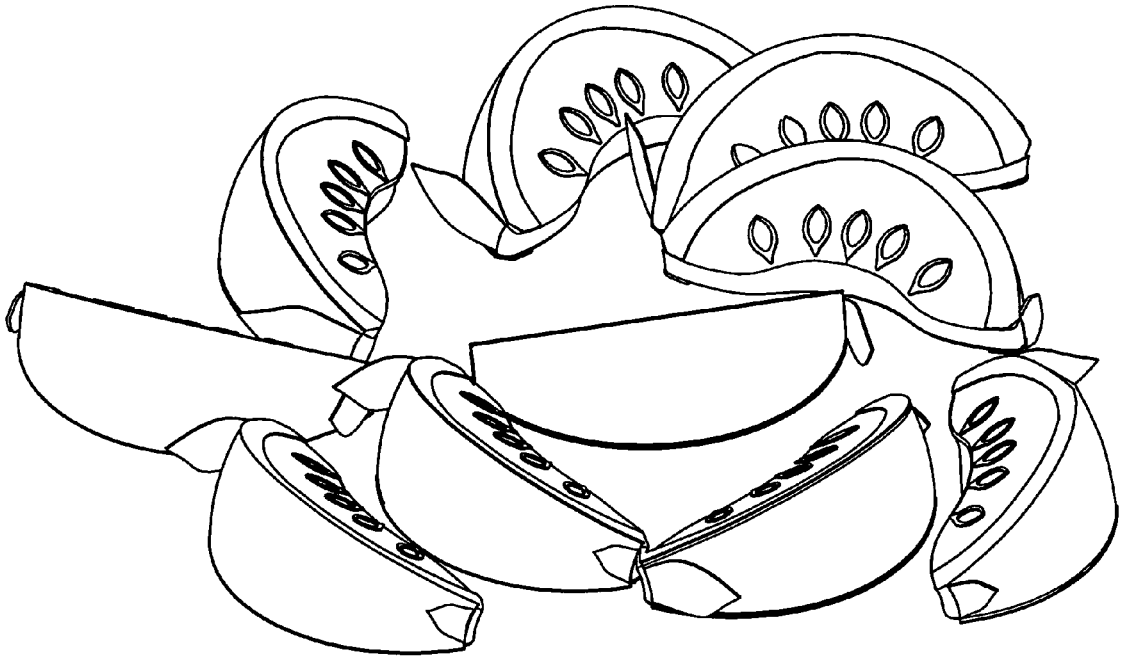
FIG. 8 is a perspective view of 10 said cushions in a random configuration.

FIG. 8 shows a random configuration of ten cushions, on a floor for example. This configuration provides children with a group seating arrangement, for storytelling, games, and so forth.

Figure 9:
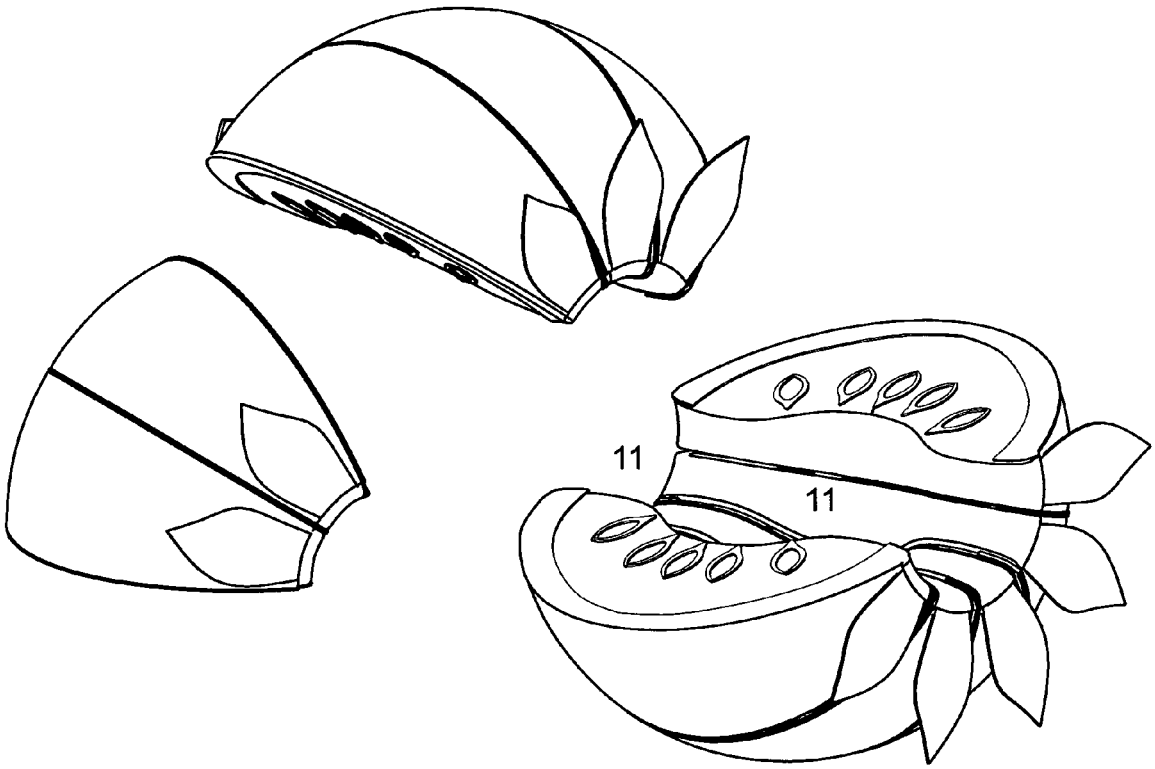
FIG. 9 is a perspective view of 10 said cushions in a random configuration.
Figure 10:
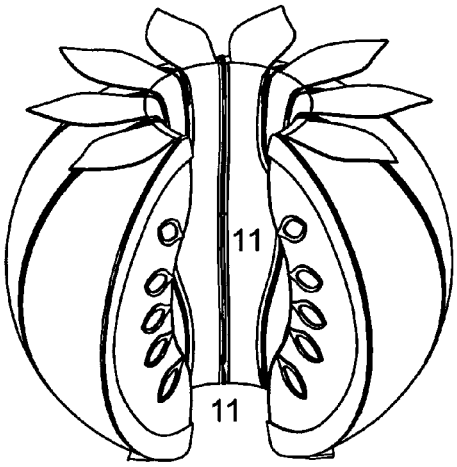
FIG. 10 is a perspective view of a partial assembly of cushions showing spherical configuration.

FIGS. 9 and 10 show configurations of cushions as partially-assembled spheres or hemispheres. These configurations may be used as rocking chairs, or for a variety of play or furniture uses.

Figure 11:
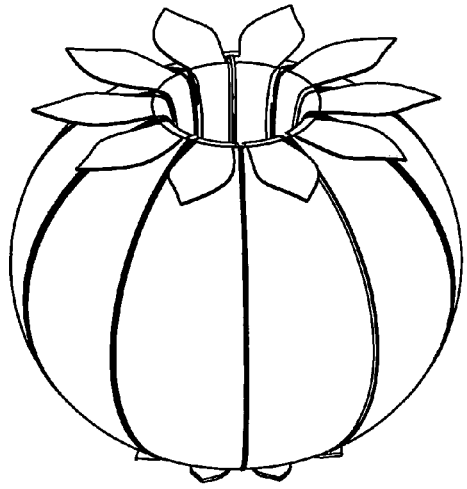
FIG. 11 is a perspective view of a full assembly of cushions showing spherical configuration.
Figure 12:
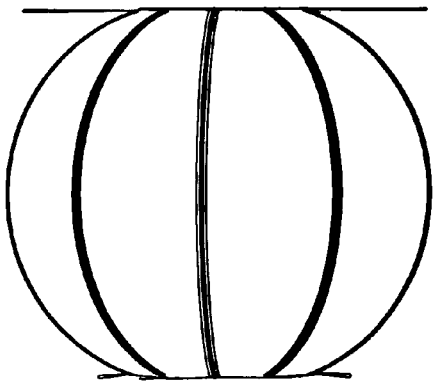
FIG. 12 is a side view of the said assembly of FIG. 11.
Figure 13:
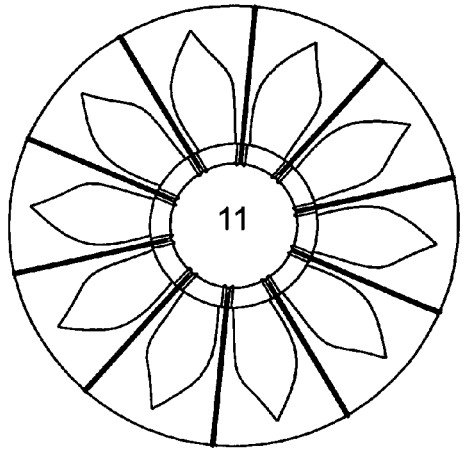
FIG. 13 is a top view of the same assembly of FIG. 12.

FIGS. 11 12 and 13 show the preferred embodiment in full spherical configuration. The proportions of said spherical configuration should relate to those of the user, a child. The spherical assembly may be designed with a smaller circumference, which would therefore be suitable for younger and/or smaller children. Therefore the child relates ergonomically and psychologically to the assembly as furniture, as opposed to a hand-held device, or an architectural space.

Figure 14:
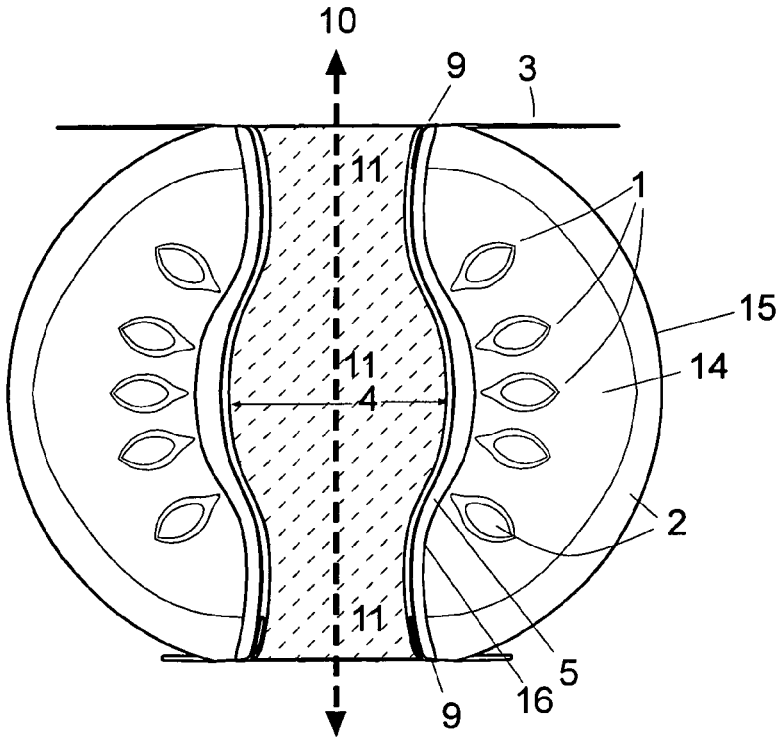
FIG. 14 is a front view of 5 cushions assembled in hemispherical configuration, showing the contour of the hollow core created in this assembly, and imaginary central axis.

FIG. 14 shows five cushions of a ten-cushion set assembled in hemispherical configuration. This view shows a hollow core 11 that is created by recessing features 5 9 16 from said hemisphere's imaginary central axis 10. This allows a child to crawl into and rest inside the cavity created by this recess when the cushions are completely assembled into spherical configuration. When the cushions are assembled as a hemisphere or open portion of a sphere, said recess creates a concave, cradle-like shape, whereby creating a place for sitting or reclining. Since the assembly can never be "closed", said recesses are also a safety feature to prevent suffocation, particular in full spherical assembly.

Figure 15:
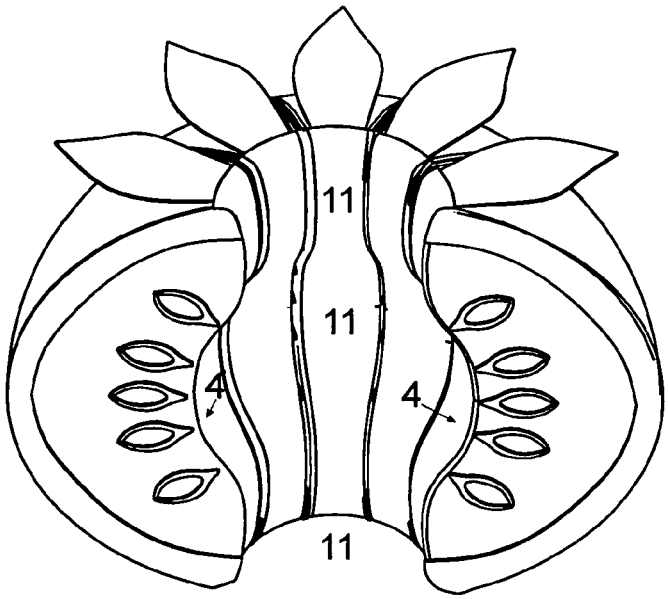
FIG. 15 is a perspective view of the said assembly of FIG. 14.

FIG. 15 is similar to FIG. 14, but shows the assembly from a perspective angle, in order to further illustrate the size and shape of said hollow core 11.

Figure 17:
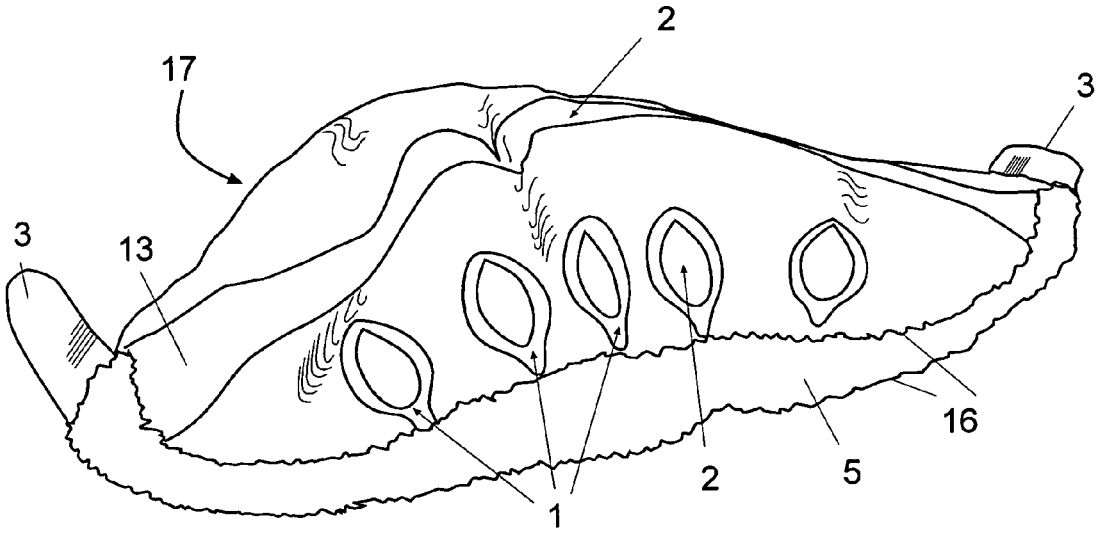

FIGS. 16 and 17 show a cushion disassembled into a base 7 an exterior cover 17, respectively. Said base's preferred material of construction is foam (FIG. 16). The foam may be manufactured from layers of foam, or from a foam shell which is then filled with foam dust or stuffing. The foam may also be injection-molded in a computer-aided milled mold. The foam material may be polyurethane, or EVA foam, which complies with more safety regulations, or other semi-rigid material. Said base 7 may also be constructed from an inflatable bladder. Such a bladder may contain internal flanges, the edges of said flanges welded to the internal surfaces of said bladder, whereby retaining the desired flat and concave surfaces when the bladder is inflated. Maintaining the slanted surfaces flat is necessary to allow the cushions to recombine in regular geometric patterns.

Said exterior cover 17 is preferably manufactured of washable fabric, because a) it is likely that children's regular use will soil the cushions, and b) children have stated in focus groups that they prefer soft, plush surfaces (as opposed to wood, rubber, etc.). Said cover's preferred embodiment contains a re-sealable opening 6 (FIGS. 3 5 18), such as a zipper, or a length of hook and loop fabric, or a length of overlapping edges which create a pocket-like closure. The preferred position for the opening is along said outer face of said cushion 13, for two reasons: a) zippers and Velcro tend to sew smoother along straight or concave surfaces, and b) such a large opening relative to the base 7 construction makes it easier for the user to remove and replace the cover from the foam. The length of the opening should be proportionally smaller than the length of the longest parallel length of the base 7 which needs to be removed from that opening. FIG. 17 shows said cover 17 as limp non-because it is not stretched taut over said base 7. Therefore in FIG. 17, reference numbers that indicated geometric forms in FIGS. 1 2 3 4 5 6 7 14, indicate where these forms would occur when assembled over said base 7.

The inventor contemplates an alternative method of construction, in which a stiff outer exterior covers a less rigid, inner filler material. The outer exterior might be sewn from thick industrial felt or other stiff yet pliable material. The inner material may include but is not limited to small Styrene balls (such as those used in bean-bags), or polyester fiber filling, or other material. Such a stiff shell material would maintain the flatness of the cushions' connecting surfaces.

Said cover's inner surface 5, which corresponds to said cushion's said inner surface 5 of the cushions may be tailored with a furry or plush fabric, whereby suggesting the inner fuzz-like texture of a piece of fruit. This also makes the child's physical experience of lying on this part of the cushion more pleasant.

Figure 18:
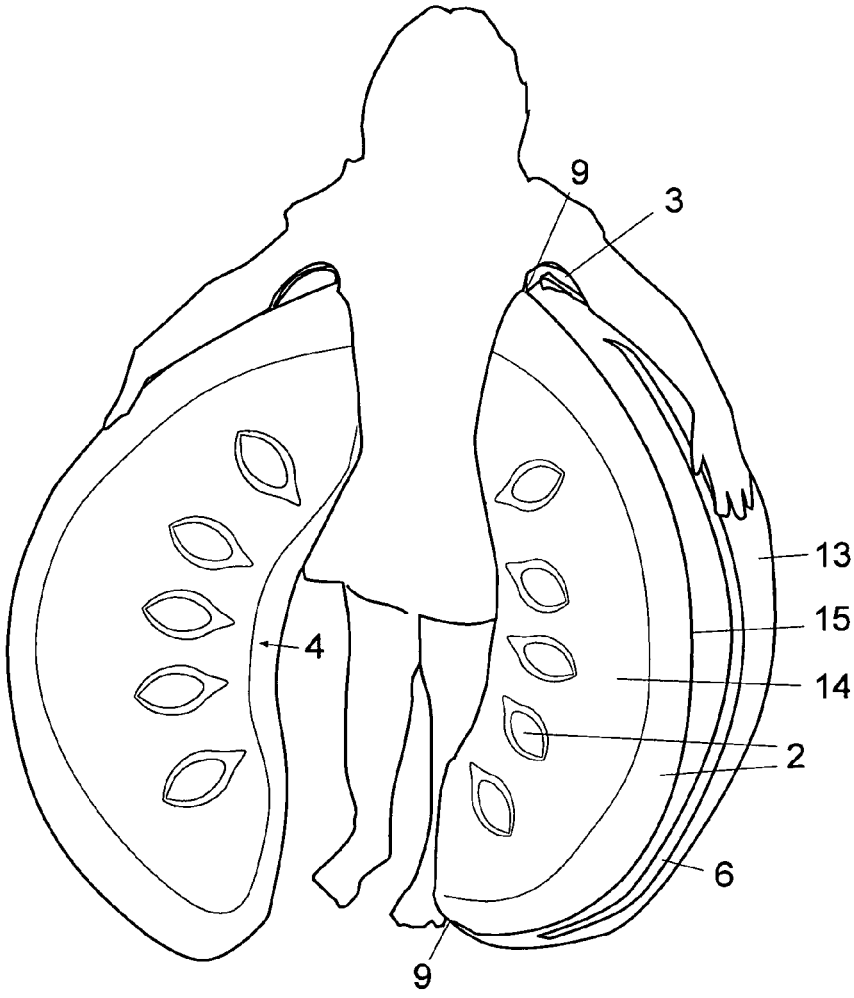
FIG. 18 is a perspective view of a child holding two of the cushions.
Figure 20:
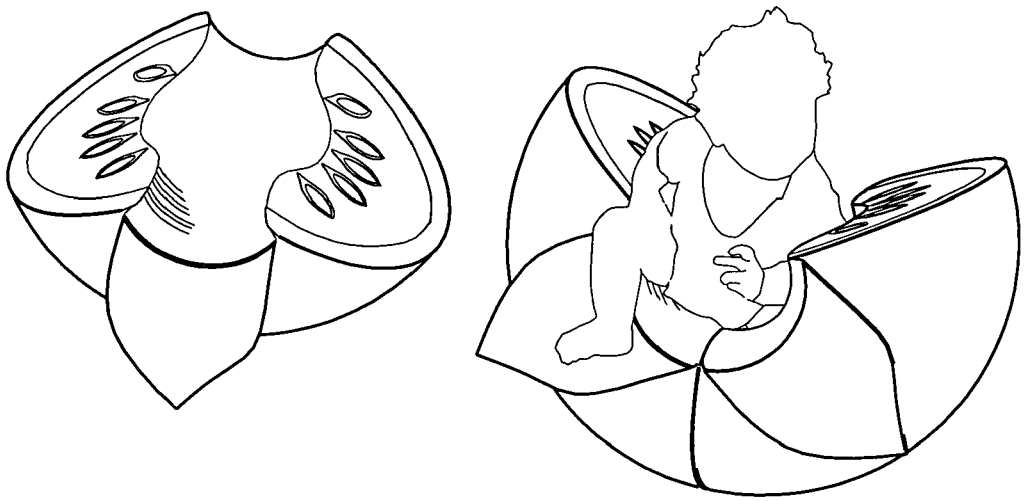
FIG. 20 is another perspective of an alternate embodiment composed of three cushions, showing use by a child.

FIG. 18 shows a child standing with two of said cushions illustrated in FIG. 1. The image shows size reference of the preferred embodiment. FIG. 20 shows an alternate embodiment of the invention, a three-cushion assembly. A toddler sits in the hollow core 11. For a smaller embodiment, it is preferable to use a fewer number of wedges, a three-cushion assembly. This is because it is easier to manufacture plush or foam construction in larger, more massive parts, not in smaller, precision parts. This is also because a child's ergonomic dimensions and requirements remain the same, so with a smaller assembly, larger cushions are needed. Therefore, the smaller the circumference of the spherical configuration, a proportionately fewer number of cushions is recommended.

Figure 19:
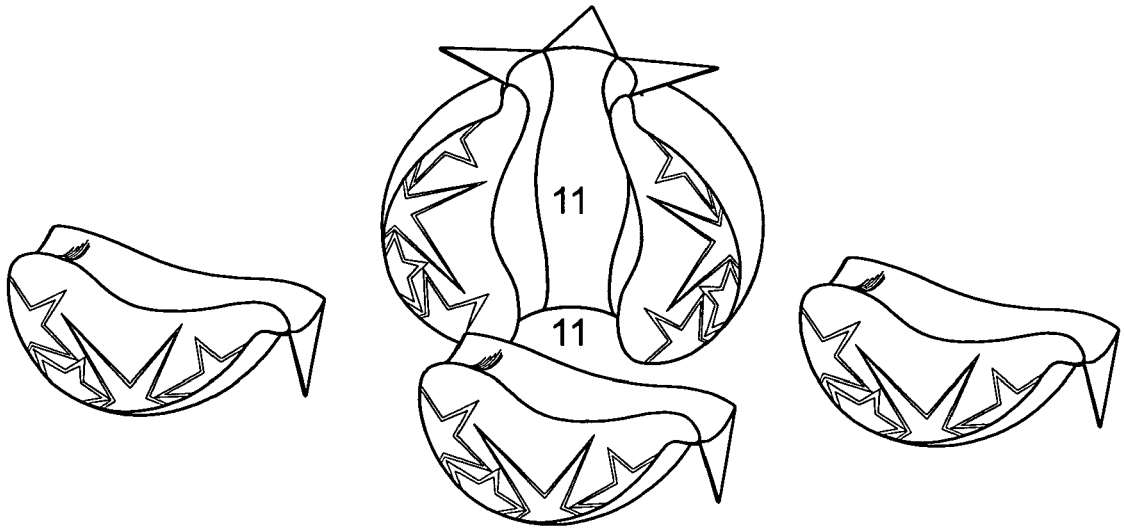
FIG. 19 is a perspective view of an alternate embodiment composed of six cushions.

FIG. 19 shows the cushion of FIG. 2 in an assembly of six cushions.

Figure 21:
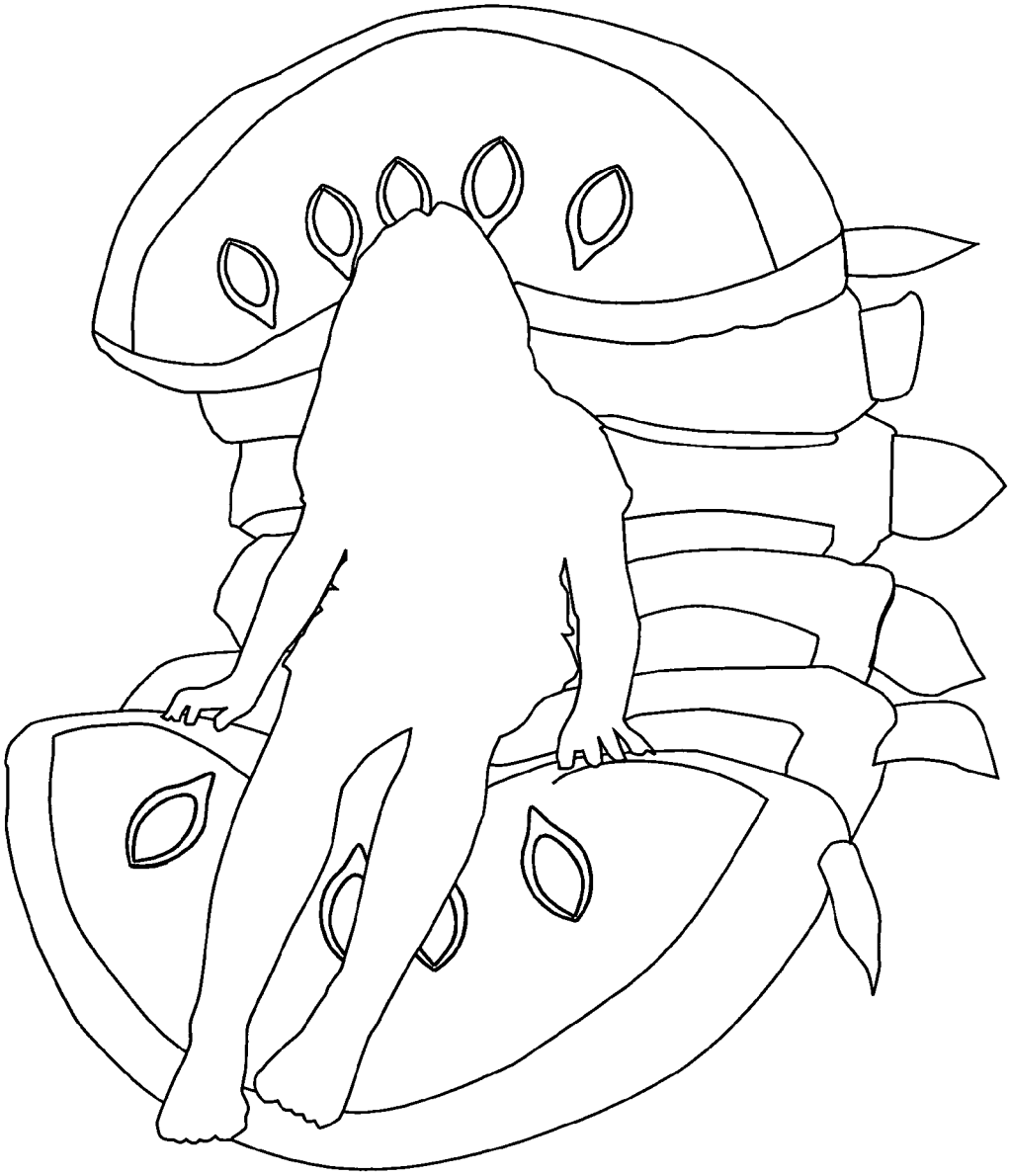
FIG. 21 is a perspective of the preferred embodiment in a hemispherical configuration, in use by child.

FIG. 21 shows the cushions illustrated in FIG. 1 in use as a chair or rocking chair. A child sits in the hollow core 11.

RELATED FOREIGN IP:

Israeli Design Patent Pending, Israel Ministry of Justice,

| Application Number | Application Date | Application Title | Inventor's Name | Type of IP |
|---|---|---|---|---|
| 41196 | Sep. 08, 2005 | Modular Furniture for Children | Jessica Cohen | Design patent application |

-continued

| Application Number | Application Date | Application Title | Inventor's Name | Type of IP |
|---|---|---|---|---|
| 41944 | Feb. 02, 2006 | Modular Furniture for Children | Jessica Cohen | Design patent application |

PRIOR ART

| Inventor Name | Patent or Application # | Invention Title | Date |
|---|---|---|---|
| Wassilefsky, Gerda | 20020088057 | Leg spacer pillow | Jul. 11, 2002 |
| Trzos; Irene Wanda | 5,951,403 | Hemispherical rolling toy | Sep. 14, 1999 |
| Clarke; William A. | 4,077,625 | Pneumatic cushion toy | Mar. 7, 1978 |
| Arato; Oscar T. | 4,078,792 | Hollow perforated cushion recreational toy | Mar. 14, 1978 |
| Murphy; Michael E. | 4,628,557 | Adjustable hospital mattress with removable inserts | Dec. 16, 1986 |
| Rose; Macarena M. | 6,292,964 | Inclined support pillow | Sep. 25, 2001 |
| Lindsey; Alan | 5,906,530 | Polyhedral structural systems | May 25, 1999 |
| Lindsey; Alan | 5,743,786 | Balloon face polyhedra | Apr. 28, 1998 |
| Chen; Tao-Ming | 6,652,421 | Physical workout ball | Nov. 25, 2003 |
| Yang; Lien Chuan | 6,945,919 | Balance-exercising semi-spherical apparatus | Sep. 20, 2005 |
| McCloskey; George | 6,298,508 | Kneel cushions | Oct. 9, 2001 |
| Saro; Jack H. B. et al | 5,448,790 | Selectively arrangeable cushion assembly | Sep. 12, 1995 |
| Chee; Edward K. | 5,137,333 | Seat cushion | Aug. 11, 1992 |
| Rose; Macarena M. | 6,292,964 | Inclined support pillow | Sep. 25, 2001 |
| DuDonis, Matthew | 20050005358 | Immobile patient positioning aid | Jan. 13, 2005 |
| Schlieps; Mark A | 20060080780 | Plumbers Support Pillow | Apr. 20, 2006 |

The invention claimed is:

1. An article of furniture for play and education, comprising:

a set of attachable cushions, wherein each of said cushions has a wedge shape formed by an inner surface having an outer perimeter, a convex outer surface having an outer perimeter larger than said outer perimeter of said inner surface, and first and second flat faces connecting said inner and outer surfaces, and wherein each of said cushions has at least one first fastener on said first flat face, and at least one second fastener on said second flat face; and wherein said set of attachable cushions are adapted to form a substantially spherical shape upon fastening said at least first fastener of each of said cushions to said at least one second fastener of another of said cushions such that said inner surfaces of said cushions create a substantially concentric interior surface to form a hollow core of said substantially spherical shape.

2. The article of furniture of claim 1, wherein said inner surface of each of said cushions has a recess therein.

3. The article of furniture of claim 1, wherein the set of cushions forms a sphere.

4. The article of furniture of claim 1, wherein connecting at least two of the cushions together forms a shape with a recessed area.

5. The article of furniture of claim 4, wherein said at least two cushions form a portion of a sphere.

6. The article of furniture of claim 1, wherein at least two of said cushions are arranged to form at least one of: a ball, a rocking chair, a group seating area, a crib, and a bide-and-seek toy.

7. The article of furniture of claim 1, wherein each cushion is situated at a different place, and connecting a single edge of at least one cushion to the single edge of another cushion forms a group seating arrangement.

8. The article of furniture of claim 1, further comprising a semi-rigid base.

9. The article of furniture of claim 8, wherein the semi-rigid base is manufactured from at least one of the following materials: solid foam, polystyrene particles; an air-filled bladder; and shredded foam particles.

10. The article of furniture of claim 1, further comprising at least one flexible, exterior cover for covering at least a part of at least one cushion.

11. The article of furniture of claim 10, wherein each of said at least one first and second fasteners comprises at least two fastening elements placed in an array.

12. The article of furniture of claim 11, wherein, when said cover is on a cushion, the placement of at least one array of fastening elements on said cover corresponds to a flat surface area of the cushion.

13. The article of furniture of claim 10, wherein the cover fits over a semi-rigid base.

14. The article of furniture of claim 1, wherein each of said at least one first and second fasteners enables at least two of said cushions to be attached in series.

15. The article of furniture of claim 1, further comprising at least one element affixed to at least one cushion, wherein said at least one element directs to the user in which direction to align the cushions.

* * * * *